US006781308B2

(12) United States Patent
Hayashi

(10) Patent No.: US 6,781,308 B2
(45) Date of Patent: Aug. 24, 2004

(54) PLASMA DISPLAY PANEL HAVING A FLUORESCENT LAYER MADE OF MONO-CRYSTAL PARTICLES

(75) Inventor: Masato Hayashi, Tokyo (JP)

(73) Assignee: NEC Corporation, Tokyo (JP)

( * ) Notice: Subject to any disclaimer, the term of this patent is extended or adjusted under 35 U.S.C. 154(b) by 126 days.

(21) Appl. No.: 10/041,623

(22) Filed: Jan. 10, 2002

(65) Prior Publication Data

US 2002/0089284 A1 Jul. 11, 2002

(30) Foreign Application Priority Data

Jan. 10, 2001 (JP) ..... 2001-002171

(51) Int. Cl.[7] ..... H01J 17/49
(52) U.S. Cl. ..... 313/582; 313/586; 313/587
(58) Field of Search ..... 313/582, 586, 313/587, 485, 489

(56) References Cited

U.S. PATENT DOCUMENTS 4,827,186 A * 5/1989 Knauer et al. ..... 313/485
5,701,056 A * 12/1997 Shinohara ..... 313/586
5,939,826 A * 8/1999 Ohsawa et al. ..... 313/582
6,100,633 A * 8/2000 Okumura et al. ..... 313/486
6,153,123 A * 11/2000 Hampden-Smith et al. ..... 252/301.4 S
6,252,353 B1 * 6/2001 Ha et al. ..... 313/582
6,265,825 B1 * 7/2001 Asano ..... 313/582

FOREIGN PATENT DOCUMENTS

JP 06260092 A * 9/1994 ..... H01J/11/02
JP 10074455 A * 3/1998 ..... H01J/9/227
JP 11213892 A * 8/1999 ..... H01J/11/02
JP 20002944148 * 8/2000 ..... H01J/11/02
JP 2000294151 A * 10/2000 ..... H01J/11/02
JP 2001229009 A * 8/2001 ..... G06F/7/52
WO WO 2002064701 A1 * 8/2002 ..... C09K/11/08

* cited by examiner

*Primary Examiner*—Ashok Patel
*Assistant Examiner*—Mariceli Santiago
(74) *Attorney, Agent, or Firm*—Sughrue Mion, PLLC

(57) ABSTRACT

A phosphor (fluorescent material) making up of a fluorescent layer of a plasma display panel is made of mono-crystal particles, which each have a particle diameter of 10–200 nm.

13 Claims, 3 Drawing Sheets

PLASMA DISPLAY PANEL HAVING A FLUORESCENT LAYER MADE OF MONO-CRYSTAL PARTICLES

BACKGROUND OF THE INVENTION

1. Field of the Invention

The invention relates to a plasma display panel and, more particularly to, such the plasma display panel that improves a light emitting utilization efficiency.

The present application claims priority of Japanese Patent Application No.2001-002171 filed on Jan. 10, 2001, which is hereby incorporated by reference.

2. Description of the Related Art

Presently a plasma display panel is being developed as a flat panel display which substitutes for a CRT (Cathode Ray Tube)

FIG. 3 is a cross-sectional view for showing a conventional AC (Alternating Current) plane direction-discharge type of plasma display panel.

The above-mentioned conventional plasma display panel, as shown in FIG. 3, includes a rear-side glass substrate 7 and a front-side glass substrate 12.

The rear-side glass substrate 7 is provided with a plurality of linear data electrodes 6 covered by a white dielectric 5. The front-side glass substrate 12 is provided with a plurality of linear transparent electrodes 10 made up of a nesa film and a plurality of linear trace electrodes 11 which are covered by a protection layer 8 and a transparent dielectric 9. The rear-side glass substrate 7 and the front-side glass substrate 12 are sealed with a sealing material. There is formed a plurality of discharge cells 14, 14, . . . separated each other by partitions 4, 4, . . . between the rear-side glass substrate 7 and the front-side glass substrate 12. The partitions 4 on the white dielectric 5 serve as walls of the discharge cell 14, so that the white dielectric 5 and the partition 4 are covered by a white reflection layer 2 as a buffer layer and a fluorescent layer 1. In each discharge cell 14, there are placed the trace electrode 11 and the data electrode 6 as opposed to each other in a vertical direction. The plurality of trace electrodes 11 and the plurality of data electrodes 6 are formed in a matrix form as a whole. The discharge cell 14 encapsulates therein a rare gas mixture containing Ne—Xe, He—Ne—Xe, or a like.

The fluorescent layer 1 is formed by applying regions made of red, green, and blue light-emitting phosphor (fluorescent material) powder to each fluorescent film thickness of 10 $\mu$m or so on the inner surface of a predetermined cell. In this plasma display panel, an AC voltage is applied to the transparent electrode 10 on the side of the front-side glass substrate 12 with respect to the interior of the discharge cell 14 to give rise to surface discharge in order to excite phosphors making up of the fluorescent layer 1 by a vacuum ultraviolet ray generated by Xe-gas discharge, thus emitting a visible light.

Conventionally, phosphors making up of the fluorescent layer 1 have been manufactured by baking by use of flux. A phosphor particle obtained by this manufacturing method is a poly-crystal having an average particle diameter of a few micrometers. To transform such the phosphor into paste to thereby form the fluorescent layer 1, this fluorescent layer 1 is considered to have a film thickness of 10 $\mu$m or so. This is because a thinner film of the fluorescent layer 1 is considered to reduce the number of phosphor particles that can be excited. A thicker film, on the other hand, narrows discharge space and also deteriorates reflecting effect of the white reflection layer 2 owing to the phosphor particles. Actually, a current plasma display plane has a light emitting efficiency of 1.0 [lm/W] or so, which is problematically low as compared to that of a CRT. If increasing in light emitting efficiency of the phosphor can be achieved, the luminance and hence the picture quality can be improved. Also, such improvements can reduce power dissipation.

With a conventional method for manufacturing fluorescent materials, emitted light intensity tends to decrease as the particle diameter decreases. Because it is possibly required to lower the baking temperature to suppress the size of the phosphor particle diameter deteriorates the crystallinity, thus decreasing in the emitted light intensity of the phosphor.

In contrast, to enhance the crystallinity in order to increase the emitted light intensity of the phosphor, the baking temperature must be raised, thus resulting in a larger size of the phosphor particle diameter.

The conventional phosphors have been manufactured at a high baking temperature of 1000° C. or higher. In baking at such a high temperature, to obtain a crystal having a good light emitting characteristic, the particle size must be a few micrometers or more in diameter. That is, a phosphor particle with a particle diameter of 1 $\mu$m or less manufactured by the conventional method has poor crystallinity, thus deteriorating the light emitting characteristic.

SUMMARY OF THE INVENTION

In view of the above, it is an object of the present invention to provide a plasma display panel having an improved light emitting characteristic, by obtaining a fluorescent material with good crystallinity.

According to a first aspect of the present invention, there is provided a plasma display panel, wherein a phosphor constituting a fluorescent layer of the plasma display panel is made of mono-crystal particles, the mono-crystal particles each having a diameter of 10–200 nm.

In the foregoing first aspect, a preferable mode is one wherein a reflection layer for reflecting a light emitted from the phosphor is provided below the fluorescent layer.

Another preferable mode is one wherein the reflection layer is made of white pigment powder. Also, a preferable mode is one wherein between the fluorescent layer and the reflection layer is provided a color filter layer for selectively transmitting only a predetermined-wavelength visible light.

A further preferable mode is one wherein the color filter layer is made of an inorganic pigment.

A still further preferable mode is one wherein the fluorescent layer has a film thickness of 0.05–1.0 $\mu$m.

An additional preferable mode is one wherein the reflection layer has a film thickness of 1–20 $\mu$m.

Another preferable mode is one wherein the inorganic pigment used to form the color filter layer has an average particle diameter of 10–200 nm.

A further preferable mode is one wherein the color filter layer has a film thickness of 10–200 nm.

Also, according to a second aspect of the present invention, there is provided a plasma display panel in which a rear-side glass substrate provided with a data electrode covered by a white dielectric and a front-side glass substrate provided with a transparent electrode and a trace electrode covered by a protecting layer and a transparent dielectric are both sealed by a sealing material, in which a discharge cell separated by a partition is formed, in which on the white dielectric and the partition is formed a fluorescent layer made of a fluorescent material, wherein a fluorescent layer is formed in such a manner as to cover the protecting layer of the front-side glass substrate, the fluorescent material of the fluorescent layer being made of mono-crystal particles having a particle diameter of 10–200 nm.

In the foregoing second aspect, a preferable mode is one wherein the fluorescent layer has a film thickness of 0.05–0.5 $\mu$m.

With the above configurations, it has the following effects.

A first effect is an improvement in the efficiency of taking out emitted light. A phosphor particle is excited by a vacuum ultraviolet ray emitted by Xe-gas discharge to then emit visible light in every direction. Fluorescent light reflected by a white reflection layer 22 is not degraded due to scattering by the phosphor particles.

A second effect is that the phosphor particle can be utilized efficiently because the fluorescent layer has a film thickness of a few hundreds of nano-meters, which is almost equivalent to the depth by which the vacuum ultraviolet ray will penetrate into the fluorescent layer. A conventional phosphor particle has a particle diameter of a few microns, so that the vacuum ultraviolet ray cannot penetrate deep into the phosphor, which means that only such phosphor particles that are present on the surface of the fluorescent layer can be utilized.

A third effect is that a mono-crystal phosphor particle employed mitigates a process deterioration, thus enabling the light emitting efficiency of each of the phosphor particles.

A fourth effect is that a buffer layer is provided to thereby prevent a phosphor made of ultra-minute particles from being absorbed. That is, since the existing partition 24 material or a white dielectric 25 contains a glass component, the fluorescent film is loosened by heat during the baking of the fluorescent layer, thus readily taking in the phosphor made of ultra-minute particle. Once taken in, the phosphor made of ultra-minute particles cannot obtain excitation energy from the vacuum ultraviolet ray, thus disabling light emission. To solve this problem, the buffer layer is provided to thereby prevent the phosphor made of ultra-minute particles from coming in direct contact with the materials of the partition 24 or the white dielectric 25, thus enabling avoiding take-in of the phosphor made of ultra-minute particles.

The fifth effect is that a white reflection layer 22 provided as the buffer layer causes a light emitted from the phosphor made of ultra-minute particles to be reflected totally, thus enabling efficiently taking out the light emitted from the phosphor toward the front-side glass substrate 32*a*.

The sixth effect is that an external light can be split by a color filter layer into light components corresponding to various fluorescent colors, thus improving contrast ratio.

DESCRIPTION OF THE PREFERRED EMBODIMENTS

In a construction of a plasma display panel of the present invention, mono-crystal particles with a diameter of 200 nm or less are used to form a fluorescent layer 21, which is combined with an underlying white reflection layer 22 in operation to thereby improve luminance and reduce power dissipation.

Best modes of carrying out the present invention will be described in further detail using various embodiments with reference to the accompanying drawings.

First Embodiment

Figure 1:
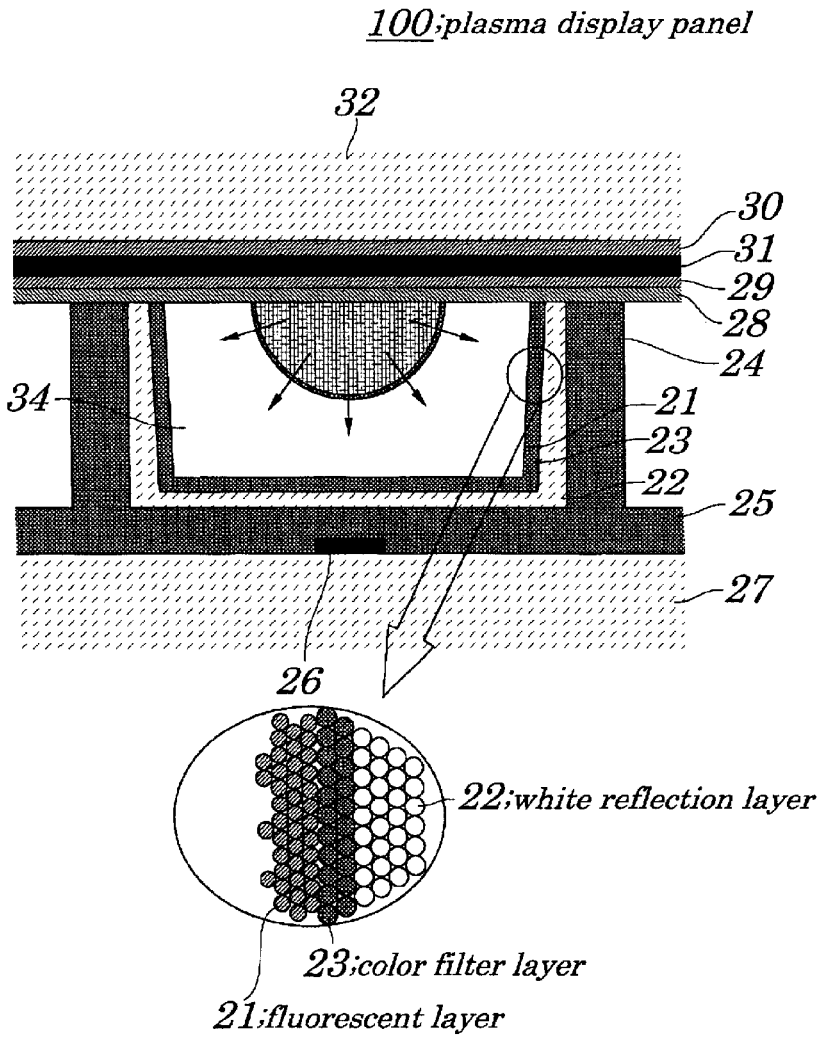
FIG. 1 is a cross-sectional view for showing a plasma display panel according to a first embodiment of the present invention.

FIG. 1 is a cross-sectional view for showing a plasma display panel 100 according to a first embodiment of the present invention.

The plasma display panel 100 according to this embodiment, as shown in FIG. 1, includes a rear-side glass substrate 27 and a front-side glass substrate 32.

The rear-side glass substrate 27 is provided with a plurality of linear data electrode 26 covered by a white dielectric 25. The front-side glass substrate 32 is provided with a plurality of linear transparent electrode 30 made up of a nesa film and a plurality of linear trace electrode 31 which are covered by a protection layer 28 and a transparent dielectric 29.

The rear-side glass substrate 27 and the front-side glass substrate 32 are sealed with a sealing material. There is formed a plurality of discharge cells 34, 34, . . . separated each other by partitions 24, 24, . . . between the rear-side glass substrate 27 and the front-side glass substrate 32. The partitions 24 on the white dielectric 25 serve as walls of the discharge cell 34, and the partitions 24 and the white dielectric 25 are covered by a white reflection layer 22 and a color filter layer 23 and a fluorescent layer 21. In each discharge cell 34, there are placed the trace electrode 31 and the data electrode 26 as opposed to each other in a vertical direction. The plurality of trace electrodes 31 and the plurality of data electrodes 26 are formed in a matrix form as a whole. The discharge cell 34 encapsulates therein a rare gas mixture containing Ne—Xe, He—Ne—Xe, or a like.

A light emitting layer of the plasma display panel 100 according to this embodiment includes the white reflection layer 22 and the color filter layer 23 made up of particles with an almost sub-micron order average diameter and the fluorescent layer 21 made of mono-crystal phosphor having a particle size not larger than a sub-micron order. The white reflection layer 22 and the color filter layer 23 are collectively applied to the internal surface of the partition 24 and dried, and then the three-color (red, green, and blue) phosphors are applied on the color filter layer 23, hereby forming the fluorescent layer 21.

A preferable phosphor making up of the fluorescent layer 21 according to the embodiment may include the following but are not limited hereto. A red phosphor (fluorescent material) may include (Y, Gd)$BO_3$:EU, $YBO_3$, $GdBO_3$:Eu, $(Y, Gd)_2O_3$:Eu, $Y_2O_3$:Eu, $Gd_2O_3$:Eu, or a like. A green phosphor may include $BaAl_{12}O_{19}$:Mn, $BaMgAl_{10}O_{17}$:Mn, $Zn_2SiO_4$:Mn, (Y, Gd)$BO_3$:Tb, $YBO_3$:Tb, or a like. A blue phosphor may include $BaMgAl_{10}O_{17}$:Eu, $CaWO_4$:Pb, $Y_2SiO_5$:Ce, $CaAl_2O_4$:Eu, or a like.

As the phosphor particle of which the fluorescent layer 21 is made, such a mono-crystal phosphor particle is employed that has a diameter not larger than a sub-micron order. Specifically, such a particle that has an average diameter of 10–200 nm. A phosphor particle with an average diameter less than 10 nm is difficult for its light emitting center to exist in such a state that it can emit light, while a phosphor particle with an average diameter in excess of 200 nm is difficult to be manufactured. The film thickness of the fluorescent layer 21 is preferably 0.05–1.0 μm and, more preferably, 0.1–0.5 μm. If the film thickness is less than 0.05 μm, vacuum ultraviolet ray utilization efficiency is deteriorated owing to light emitted from the phosphor and, if it is in excess of 1 μm, on the other hand, it is impossible to obtain such an effect that can be obtained using a phosphor particle with a diameter of a sub-micron order. Also, reportedly a vacuum ultraviolet ray (147 nm) emitted by Xe-gas discharge penetrates by only a few hundreds of nano-meters from the surface of the phosphor particle, so that if the average particle diameter exceeds the value, discharge space is narrowed, thus possibly decreasing the emitted light intensity.

To form a fluorescent layer 21 using mono-crystal phosphor particles with the above-mentioned sub-micron order diameter, the phosphor powder of each color is applied by screen printing, injection printing, or dispenser printing using paste which is mixed in preparation with a binder solution containing terpineol, n-butyl-alcohol, ethylene-glycol, and water.

The white reflection layer 22 and the color filter layer 23 are provided as buffer layers to prevent the mono-crystal phosphor particles with a sub-micron order diameter from being absorbed to a glass component of a partition material or a white dielectric material and to reflect a light emitted from a light emitting material toward the front-side surface and also to provide a color filter effect of suppressing reflection of external light. The white reflection layer 22 and the color filter layer 23 as buffer layers may be made of the following kinds of particles but not limited thereto. At least one kind of particle is selected from a group consisting essentially of, for example, $TiO_2$, $Al_2O_3$, $SiO_2$, MgO, $BaTiO_3$, $MgF_2$, and a like, which can totally reflect a visible light. Preferably the employed material has an average particle diameter of 10–200 nm. A particle having a diameter in this range is capable of efficiently scattering light (visible light) emitted from the fluorescent layer 21. Preferably the white reflection layer 22 has a film thickness of 1–20 μm and, more preferably, 5–15 μm. If the film thickness of less than 1 μm, the effect is deteriorated which reflects a light emitted from the phosphor and if it exceeds 20 μm, the effect given by a smaller phosphor particle diameter cannot be obtained, so that the discharge space is narrowed, thus decreasing the intensity of a light emitted from the phosphor. Also, a color filter material is made of an inorganic pigment, so that each of the fluorescent colors employs each corresponding component.

The white reflection layer 22 and the color filter layer 23 as buffer layers are made of such a material that will not be decomposed nor melted by the heat generated during the baking of the fluorescent film, so that the phosphor is not taken in nor combined, thus enabling obtaining excitation energy of a vacuum ultraviolet ray.

The fluorescent layer 21 is thin enough for the most of external light to pass through to the above-mentioned white reflection layer 22. Since the external light is mostly reflected by the white reflection layer 22, black luminance is increased when the fluorescent layer 21 is emitting a light, thus decreasing the contrast. This in turn decreases unnecessary reflection on each of the fluorescent layers 21 to thereby improve the color impurity of each color, so that it is effective to provide the color filter layer 23 between the fluorescent layer 21 and the white reflection layer 22. Such a pigment is used in the color filter layer 23 that corresponds to each color of light emitted from each of the phosphors. Preferably the material used has an average particle diameter is 10–200 nm. A particle having a diameter in this diameter range will transmit a light (visible light) emitted from the fluorescent layer 21 without interfering it. Preferably the color filter layer 23 has a film thickness of 0.1–5 μm and, more preferably, 0.5–3 μm. If the film thickness is less than 0.5 μm, the effect of splitting an external light is deteriorated; and if it exceeds 5 μm, on the other hand, a light emitted from the fluorescent layer 21 is absorbed much more into the color filter layer 23, thus decreasing the intensity of the light emitted from the fluorescent layer 21.

The following will describe how to manufacture a phosphor having a nano-meter order particle diameter and making up of a fluorescent layer 21.

Material gases or material vapors are mixed in a pre-reaction chamber and then introduced into a reaction chamber using a carrier gas. A laser beam is applied to the reaction chamber to heat the material gas mixture to a high temperature instantaneously to synthesize specified phosphors. It is cooled soon and collected by a filter. Material gases or material vapors are mixed in a gaseous condition and therefore done so at a level of molecules or atoms, so that they can be actually mixed to obtain a complex material comparatively easily. Also, by appropriately selecting a kind of the carrier gas employed, such a compound as an oxide, sulfide, or nitride can be synthesized easily. In the reaction chamber, the mixture gas is rapidly heated to be reacted owing to a high level energy of the laser beam. As a result the particles are taken out by a vacuum pump from the reaction chamber before they grow large. In this step, the particles are cooled rapidly and so can be collected by the filter without growing by joining with any other particles. Actually, however, they aggregate with each other slightly and so can be collected, which aggregation is of almost no problem practically because it can be dissolved by supersonic vibration.

Thus, by controlling flow rates of these material gases and the carrier gas and a laser output, the specified phosphors can be synthesize which has a uniform composition and a uniform particle diameter.

In such a construction of the light emitting layer as mentioned above, a vacuum ultraviolet ray emitted by the discharge of a Xe gas present in the discharge cell excites the phosphor particles to thereby emit a visible light. The light emitted from the phosphor particles is radiated in every direction, so that the emitted light radiated toward the front-side glass substrate 32 is taken out as it is to the outside. The emitted light radiated toward the rear-side glass substrate 27, on the other hand, is reflected by the white reflection layer 22 to then be taken out to the front-side glass substrate 32. Thus, the effect is improved of taking out the light emitted from the phosphor. Since this embodiment employs mono-crystal phosphor particles having a diameter less than a sub-micron order, the discharge space can be widened as compared to a case of employing phosphor particles having a diameter of a few microns, thus improving also vacuum ultraviolet-ray utilization efficiency. Further, employment of the phosphor particles with a diameter less than a sub-micron order prevents light emitting utilization efficiency from being deteriorated due to scattering at the phosphor particles. The external light is split by the color filter layer 23 into components of respective fluorescent colors. This can reduce the amount of the external light totally reflected by the white reflection layer 22, thus improving the contrast ratio.

Second Embodiment

Figure 2:
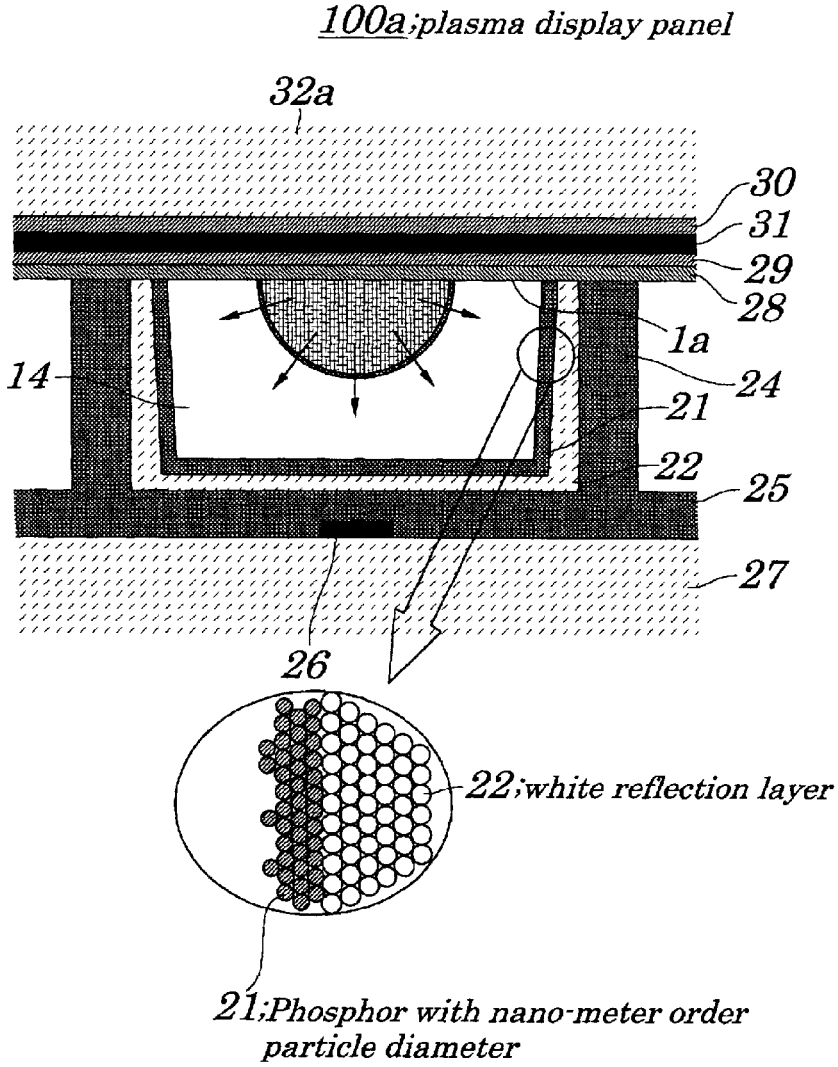
FIG. 2 is a cross-sectional view for showing a plasma display panel according to a second embodiment of the present invention.
Figure 3:
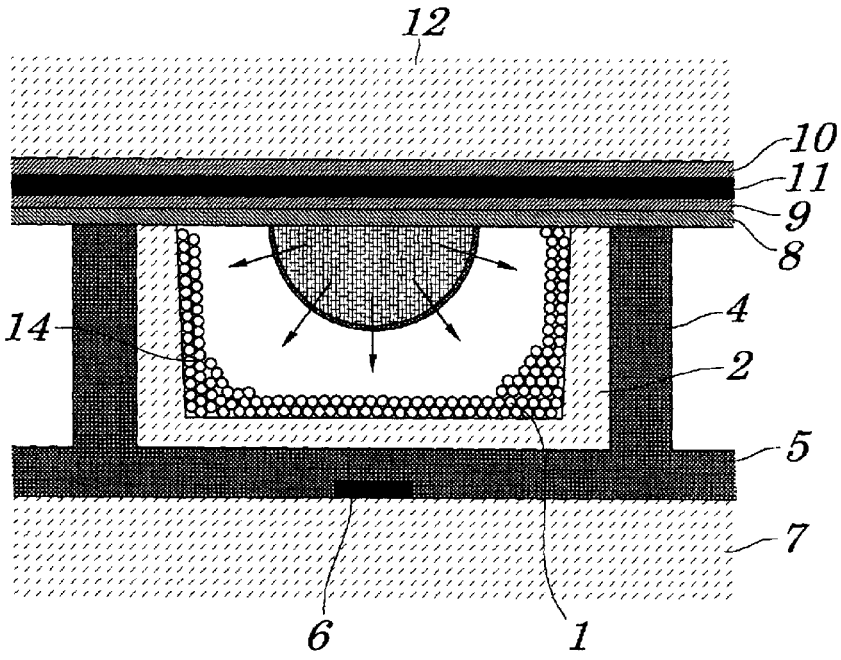
FIG.3 (PRIOR ART)
FIG. 3 is a cross-sectional view for showing a conventional plasma display panel.

The following will describe the second embodiment of the present invention with reference to FIG. 2.

FIG. 2 is a cross-sectional view for showing a plasma display panel 100*a* according to the second embodiment of the present invention. As shown in FIG. 2, the plasma display panel 100*a* according to the embodiment has the same construction as that of the first embodiment except that a fluorescent layer 1*a* to which mono-crystal phosphor particles having a diameter of less than a sub-micron order is applied is provided on the protection layer (MgO) 28 on a side of a front-side glass substrate 32*a*. Various phosphors and a method for applying the same are the same as those of the first embodiment. Preferably the fluorescent layer 1*a* has a film thickness of 0.05–0.5 μm and, more preferably, 0.1–0.3 μm. If the film thickness is less than 0.05 μm, vacuum ultraviolet ray utilization efficiency is deteriorated due to light emitted from a phosphors and if exceeds 0.5 μm, on the other hand, the fluorescent layer 1*a* acts as an interfering layer, thus deteriorating efficiency of taking out light emitted from the phosphors. Since the fluorescent layer 1*a* is provided also on the side of the front-side glass substrate 32*a* and, light emitting area is directly increased, thus enabling increasing emitted light intensity. Although such an idea has been proposed so far, a phosphor with a particle diameter of a few microns acts to interfere the light emitted from the fluorescent layer 21 on a side of a rear-side glass substrate 27, so that this idea has not been embodied as a product. This mono-crystal phosphor particle with a diameter not larger than a sub-micron order will not interfere with the light emitted from the side of the rear-side glass substrate 27, thus providing an effect of increasing the emitted light intensity.

It is apparent that the present invention is not limited to the above embodiments but may be changed and modified without departing from the scope and spirit of the invention.

What is claimed is:

1. A plasma display panel, comprising: a fluorescent layer comprising a fluorescent material which comprises phosphor mono-crystal particles, said mono crystal particles each having a diameter of 10–200 nanometers;

a reflection layer for reflecting light emitted from said phosphor material provided below said fluorescent layer; and a color filter layer for selectively transmitting only a predetermined-wavelength visible light provided between the fluorescent layer and the reflection layer, wherein said color filter layer comprises an inorganic pigment having an average particle diameter of 10–200 nanometers.

2. The plasma display panel according to claim 1, wherein said reflection layer comprises white pigment powder.

3. The plasma display panel according to claim 1, wherein said fluorescent layer has a thickness of 0.05–1.0 micrometers.

4. The plasma display panel according to claim 1, wherein said reflection layer has a thickness of 1–20 μm.

5. The plasma display panel according to claim 1, wherein said color filter layer has a film thickness of 0.1–5 μm.

6. A plasma display panel comprising:

a rear-side glass substrate provided with a plurality of data electrodes covered by a white dielectric layer;

a front-side glass substrate provided with a plurality of transparent electrodes and a plurality of trace electrodes, which are covered by a protection layer and a transparent dielectric layer, wherein both said rear-side glass substrate and said front-side glass substrates are sealed by a sealing material;

a plurality of discharge cells formed between said rear-side glass substrate and said front-side glass substrate, which are separated by partitions formed on the white dielectric layer wherein said partitions serve as walls of the discharge cells; and a fluorescent layer made of a fluorescent material covering said white dielectric layer, said partitions, and said protection layer of said front-side glass substrate, wherein said fluorescent material comprises phosphor mono-crystal particles having a particle diameter of 10 or more nanometers and less than 25 nanometers and wherein said fluorescent layer is a film having a thickness of 0.05 or more micrometers and less than 0.3 micrometers.

7. A plasma display panel, comprising: a fluorescent layer comprising a fluorescent material which comprises phosphor mono-crystal particles, said mono crystal particles each having a diameter of 10–200 nanometers;

a reflection layer for reflecting light emitted from said phosphor material provided below said fluorescent layer; and a color filter layer for selectively transmitting only a predetermined-wavelength visible light provided between the fluorescent layer and the reflection layer, wherein said color filter layer has a thickness of 0.1–5 μm.

8. The plasma display panel according to claim 7, wherein said reflection layer comprises a white pigment powder.

9. The plasma display panel according to claim 7, wherein the color filter layer comprises an inorganic pigment powder.

10. The plasma display panel according to claim 9, wherein said inorganic pigment powder has an average particle diameter of 10–200 nanometers.

11. The plasma display panel according to claim 7, wherein said fluorescent layer has a thickness of 0.05–0.1 micrometers.

12. The plasma display panel according to claim 7, wherein said reflection layer has a thickness of 1–20 μm.

13. The plasma display panel according to claim 7, wherein said color filter layer has a thickness of 0.5–3 μm.

* * * * *